United States Patent [19]

Takenaka et al.

[11] 3,994,488

[45] Nov. 30, 1976

[54] SHEET SEPARATION APPARATUS

[75] Inventors: Shumpei Takenaka; Toshio Kinoshita, both of Sagamihara, Japan

[73] Assignee: Burroughs Corporation, Detroit, Mich.

[22] Filed: Nov. 10, 1975

[21] Appl. No.: 630,472

[30] Foreign Application Priority Data

Dec. 14, 1974 Japan ..... 49-151681

[52] U.S. Cl. ..... 271/98; 271/104; 271/105

[51] Int. Cl.[2] ..... B65H 3/14

[58] Field of Search ..... 271/98, 104, 105; 239/101, 102, 4

[56] References Cited

UNITED STATES PATENTS

| | | | |
|---|---|---|---|
| 1,460,314 | 6/1923 | Deck | 271/98 |
| 3,595,562 | 7/1971 | Oldroyd | 271/98 |
| 3,596,900 | 8/1971 | Sundin | 271/98 |
| 3,815,829 | 6/1974 | Gould | 239/102 |

*Primary Examiner*—Richard A. Schacher
*Attorney, Agent, or Firm*—Kevin R. Peterson; William B. Penn; Lynn L. Augspurger

[57] ABSTRACT

A sheet separation apparatus for separating one sheet-piece from a stack of sheets by a suction nozzle, characterized in that a vibration nozzle is provided in close proximity to the suction nozzle which sucks and exhausts air in turns at high speed from and to the stacked sheets to such an extent that said suction nozzle is not prevented by said vibration nozzle from sucking the uppermost sheet-piece in order to vibrate said sheet-piece.

2 Claims, 3 Drawing Figures

SHEET SEPARATION APPARATUS

BACKGROUND OF THE INVENTION

This device relates to a sheet-piece separation apparatus for the paper-supplying section of a printing machine, paper-holding machine, and particularly relates to a sheet separation apparatus which prevents the sheet from being double-fed.

Up until the present time, such sheet separation apparatus has merely been used in printing machines, paper holding machines and is designed in order to separate a sheet-piece by correctly adjusting the suction force of a suction nozzle connected to a vaccum pump. However, as is often the case, one sheet-piece can not be separated from another sheet-piece by this means.

This is disclosed a means which enables easy separation of a sheet-piece with blown air introduced at one side of the stacked sheet-piece to prevent the above-mentioned double-feeding. This means, however, includes a disadvantage in that it requires a great deal of nozzle blast and strong blowing of air in order to obtain a clearance between stacked sheets.

A further means provides up-and-down vibrations at the lower part of the stacked sheets, but this has been a doubtful operation due to its ineffectiveness.

SUMMARY OF THE INVENTION

The present device, has solved the drawbacks and disadvantages of the above-mentioned prior arts and has found that a sufficient gap between sheet-pieces in which undulating air can enter betweeen the uppermost sheet and the subsequent sheet is necessary in order to effect satisfactory suction by the suction nozzle and pick up one sheet at a time thereby. The present device is based on this principle.

To sum up, the present device relates to a sheet-piece separation apparatus comprising a suction nozzle and a vibration nozzle which, in turns, sucks and exhausts air at high speed from and to the uppermost sheet-piece up to a point where it does not prevent said suction nozzle from sucking the uppermost sheet-piece in order to vibrate the sheet-piece near the sucking nozzle.

It is an object of the present device to provide a sheet separation apparatus which allows satisfactory separation of only one sheet at a time from a stack of sheets.

Another object of the present device is to provide a sheet separation apparatus which creates a layer of undulating air between the uppermost sheet-piece and the subsequent sheet-piece.

The above features and objects of the present device will become more fully apparent when the following description is read in connection with the accompanying drawings wherein one example is illustrated by way of example.

Figure 1:
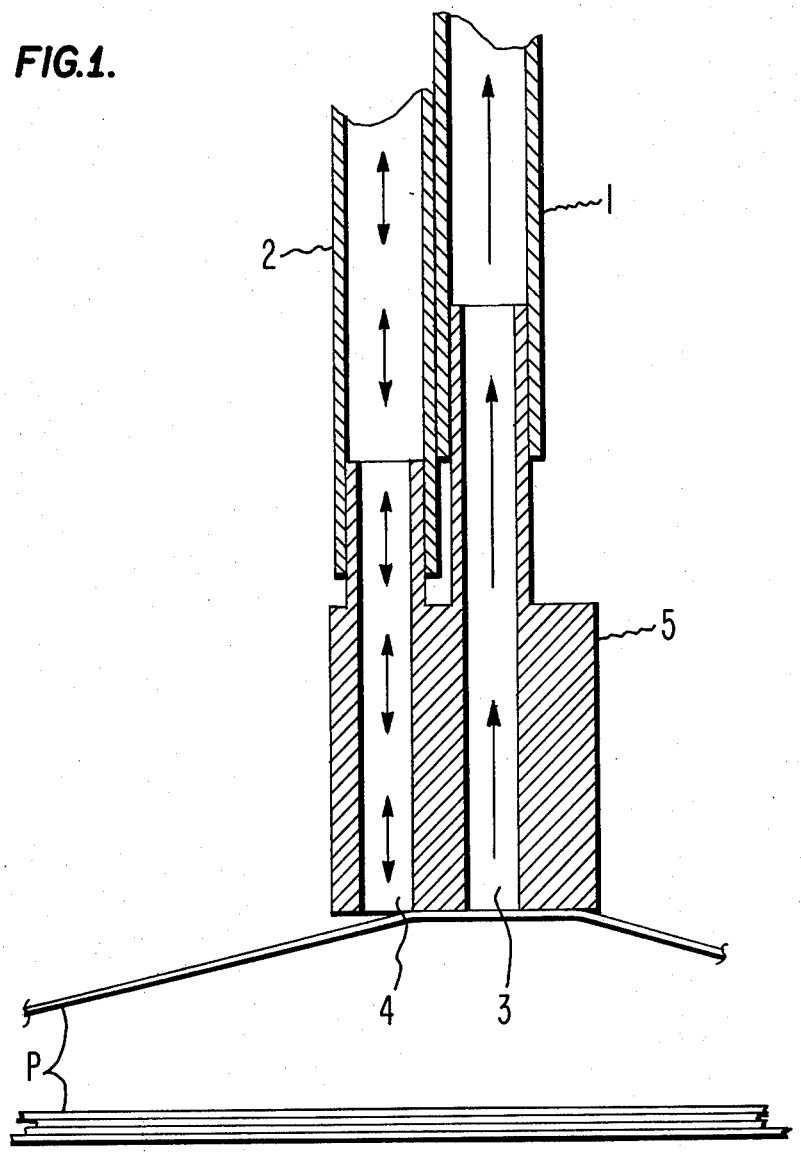
FIG. 1 is a cross-sectional view of one embodiment of the present device.

Referring to the drawings, 1 is a pipe connecting vacuum pump and a suction nozzle 3, 2 is a pipe propagating vibration from a vibratory source to a vibration nozzle 4. The vibration nozzle 4 and suction nozzle 3 are parallelly guided, respectively, to a nozzle end 5 in such a manner so as to form adjacent openings at nozzle end 5. P is a sheet-piece stacked as indicated in FIG. 1.

When the nozzle end 5 moves in the direction of the sheet-piece P, the suction nozzle 3 connected with a vacuum pump sucks air and the uppermost sheet-piece P is sucked by the same and is lifted off the stack. At the same time this suction operation takes place, vibration is effected to the sheet-piece P by the vibration nozzle 4 which is sucking and exhausting air by turns at high speed. An electric vibrator may be adapted for the vibration source.

Further, the same purpose can be achieved by means of changing a switching valve, which operates at high speed, connected at one side of pipe 2, provided with a high pressure source and low pressure source, respectively.

Vibration caused by such means provides a gap in which a layer of undulating air is created between the uppermost sheet-piece and the subsequent sheet-piece. Suction force applied to the uppermost sheet-piece is so weakened by the undulating air layer that the suction force does not affect the second or subsequent sheet-piece from separating from the stack of sheets at the same time. Consequently, the suction nozzle achieves separation of only the top sheet-piece without disturbing the subsequent sheet-piece or second piece.

It goes without saying that it is necessary to adjust the exhausting force of the vibration nozzle so as not to prevent suction force from separating and feeding a sheet.

Figure 2:
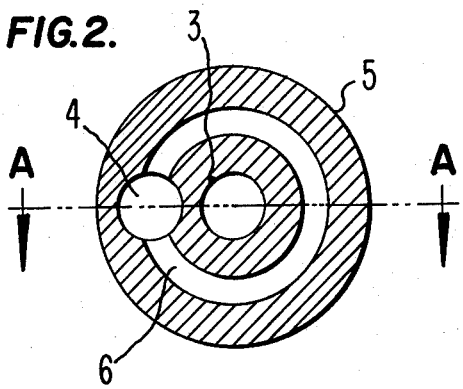
FIG. 2 is a cross-sectional view of the nozzle end in another embodiment of the present device.
Figure 3:
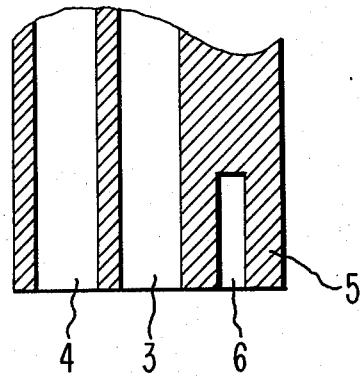
FIG. 3 is a sectional view taken along the line A—A of FIG. 2.

Furthermore, if the nozzle end 5 is constituted as indicated in FIGS. 2 and 3, a far greater effect can be expected.

Referring to the drawings, 6 is a rounded groove for effecting the gap between the uppermost sheet-piece and the second sheet-piece. As the groove 6 and both nozzle 3 and 4 form a concave areas, the nozzle end 5, due to its thickness, forms a convex area creating a concave-convex surface of the nozzle end 5 and this concave-convex area assists the vibration nozzle 4 in forming the gap between the uppermost sheet-piece and the second sheet-piece.

The present device is extremely efficient in separating one sheet-piece from another sheet-piece at one time due to the fact that the gap mentioned above is located near where the suction nozzle. sucks a sheet-piece at the top of stack and therefore, this gap allows each sheet-piece to be separated from the subsequent sheet-piece, respectively.

What is claimed is:

1. In a sheet separation apparatus for separating one sheet-piece from a stationary stack of sheet-pieces, a sheet-piece separating a suction nozzle having a vacuum port with a contact face of the suction nozzle adapted to contact the top surface of a sheet-piece of said stack of sheet-pieces, and having a second port on said contact face which is connected to a source of vibratory air, said second port being located adjacent and in close proximity to the vacuum port.

2. A suction nozzle in a sheet separator apparatus according to claim 1 wherein said second port has a porting area concentric with the perimeter of the porting area of said first vacuum port so as to provide a vibratory motion to the top piece of the stack surrounding the suction point of the suction nozzle so as to cause said sheet-piece to transmit vibration to any second sheet-piece which is in contact with the top sheet-piece and causing it to be freed from contact therewith.

* * * * *